US005634996A

United States Patent [19]

Lewis

[11] Patent Number: 5,634,996

[45] Date of Patent: Jun. 3, 1997

[54] METHOD FOR ADHERING STUDS TO CLOTH

[76] Inventor: Kathryn A. Lewis, 1627 Brickell Ave., Miami, Fla. 33129

[21] Appl. No.: 540,895

[22] Filed: Oct. 11, 1995

[51] Int. Cl.[6] ..... B44C 1/28; B44C 3/12

[52] U.S. Cl. ..... 156/63; 156/297; 156/299; 156/308.2; 206/575; 428/542.2; 434/95; 434/96

[58] Field of Search ..... 156/63, 308.2, 156/297, 299, 309.6; 206/575; 434/95, 96; 428/542.2

[56] References Cited

U.S. PATENT DOCUMENTS

| | | | |
|---|---|---|---|
| 4,016,183 | 4/1977 | Wallach | 156/63 X |
| 5,096,422 | 3/1992 | Hambright | 434/96 X |
| 5,234,340 | 8/1993 | Hambright | 434/96 X |
| 5,292,255 | 3/1994 | Goldwasser | 434/96 X |
| 5,352,120 | 10/1994 | Hambright | 434/96 X |

*Primary Examiner*—Jeff H. Aftergut
*Attorney, Agent, or Firm*—Robert C. Kain, Jr.

[57] ABSTRACT

The method of adhering studs to the cloth includes the step of providing a plurality of flat, aluminum studs having predetermined shapes. The backside surface of each stud is covered with a low temperature, heat sensitive adhesive. Also, a predetermined stud pattern is provided. The method includes laying the stud pattern atop the cloth. The stud pattern is then replicated on the cloth by marking the cloth. A corresponding stud is placed on each respective cloth mark. Thereafter, compressive force and heat, in the range of 130°–150° F., is applied to the studs and the cloth for a predetermined period of time. The heat activates the adhesive and adheres the studs to the cloth. The kit includes a plurality of studs with the heat sensitive adhesive on the backs thereof. Also, a plurality of stud patterns are included in the kit. A studed article of clothing made in accordance with the method of manufacture, is also part of this invention.

16 Claims, 4 Drawing Sheets

METHOD FOR ADHERING STUDS TO CLOTH

The present invention relates to a method of adhering studs to fabric and cloth, cloth articles made in accordance with that method, and kits for practicing the method.

BACKGROUND OF THE INVENTION

Metal studs have been utilized to decorate fabric, textiles and cloth for many years. One type of stud includes a small plate cut in a decorative shape. A number of prongs or teeth depend from the back side of these prior art studs. These studs are mounted to the cloth by forcing the stud's teeth or prongs through the cloth and then turning the teeth or prongs in a predetermined direction. The forceful compression of the prongs through the cloth and the turning of the prongs is usually accomplished by appropriately configured dies acting on the exposed surface of the stud and acting on the prongs after the prongs have pierced the cloth. In a crude sense, these types of studs are "stapled" to the cloth. Unfortunately, these studs scratch the skin when the studed articles of Clothing are worn by the user, create holes in the garments and are difficult to mount on the cloth or garment because each stud must be mounted in the die and the die must be compressed to mount the stud on the cloth. Since studded clothing usually utilizes a large number of studs (oftentimes, in excess of 50 studs), it is difficult and quite costly to mount studs on clothing.

Another type of stud is made of brass. This thin brass plate, cut into a predetermined shape, has a top, exposed face which is lacquered such that it will not tarnish. A high temperature adhesive is applied to the backside of the brass stud. This high temperature adhesive is activated at 300°–500° F. The brass studs with the high temperature adhesive are then placed in a predetermined pattern on transfer paper. The studs are temporarily mounted on the transfer paper. The studed transfer paper is laid on the clothing at the desired location. Thereafter, the brass studs are compressed and heat is applied to the compressed components at between 300°–400° F. At that temperature, the adhesive is activated and the studs are "glued on" or adhered to the garment.

OBJECTS OF THE INVENTION

It is an object of the present invention to provide a low cost, light weight, stud that can be adhered to cloth at a low temperature.

It is a further object of the present invention to utilize low temperature adhesive applied to the backside of aluminum studs.

It is a further object of the present invention to activate the adhesive by applying nominal compressive force to the stud and the clothing and applying a temperature of between 130°–150° F. for about 5–10 seconds.

It is a further object of the present invention to provide a kit which includes these aluminum studs such that the user can adhere studs to clothing by applying the heat to the studs via a common, household iron.

SUMMARY OF THE INVENTION

The method of adhering studs to the cloth includes the step of providing a plurality of flat, aluminum studs having predetermined shapes. The backside surface of each stud is covered with a low temperature, heat sensitive adhesive. Also, a predetermined stud pattern is provided. The method includes laying the stud pattern atop the cloth. The stud pattern is then replicated on the cloth by marking the cloth. A corresponding stud is placed on each respective cloth mark. Thereafter, compressive force and heat, in the range of 130°–150° F., is applied to the studs and the cloth for a predetermined period of time. The heat activates the adhesive and adheres the studs to the cloth. The kit includes a plurality of studs with the heat sensitive adhesive on the backs thereof. Also, a plurality of stud patterns are included in the kit. A studed article of clothing made in accordance with the method of manufacture, is also part of this invention.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a method for adhering studs to cloth, a kit to carry out the method and articles of studded clothing manufactured in accordance with the method.

Figure 1:
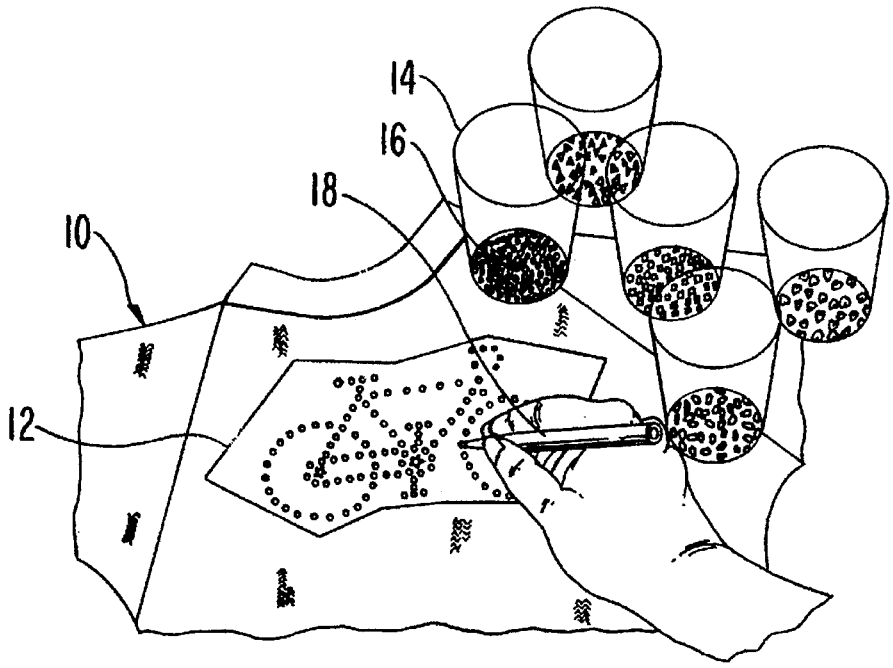
FIGS. 1, 2, 3 and 4 diagrammatically illustrate the steps utilized to adhere studs to cloth.

FIGS. 1, 2, 3 and 4 diagrammatically illustrate the major steps utilized to adhere studs to cloth. In FIG. 1, clothing article 10 has a stud pattern sheet 12 laid thereon. Sheet 12 is marked paper in this embodiment. FIG. 1 also illustrates a plurality of containers, one of which is container 14, having a plurality of studs 16 stored therein. The operator is using marker 18 to pierce stud pattern sheet 12 thereby marking the underlying region of cloth 10. In this manner, the stud pattern on pattern sheet 12 is replicated on cloth 10 by marking. It should be noted that replication could be made with a pen, pencil or a pin which pierces both pattern sheet 12 as well as the underlying cloth 10.

Figure 5:
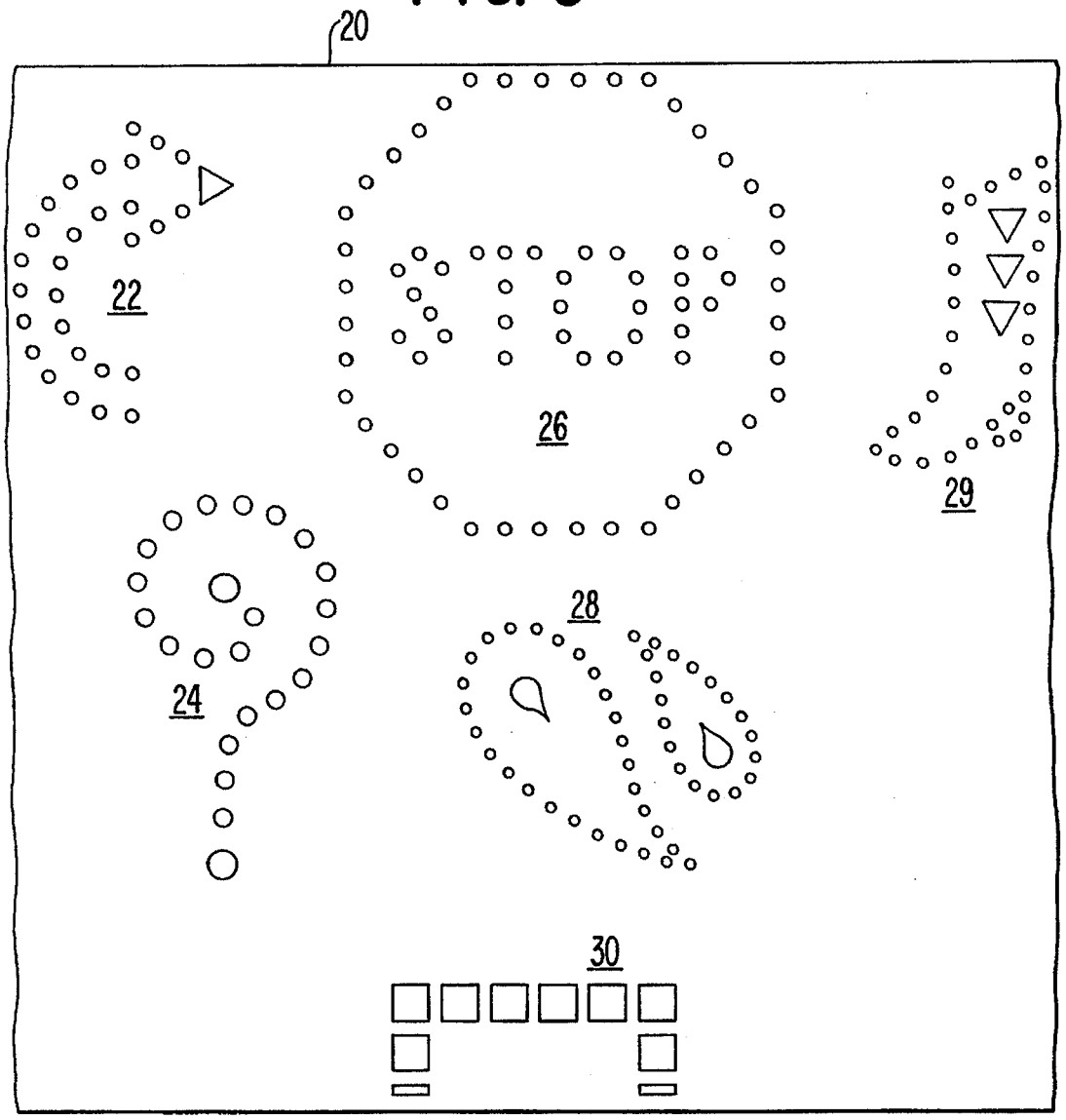
FIG. 5 diagrammatically illustrates a sheet having a plurality of stud patterns.

FIG. 5 shows another pattern sheet 20 having a plurality of patterns 22, 24, 26, 28, 29 and 30. Pattern sheet 20 is a small portion of a larger pattern sheet used in a working embodiment of the present invention. The dimensions in the patterns in FIG. 5 are substantially identical to the dimensions of the pattern in working embodiments of the invention.

Figure 6:
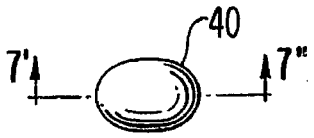
FIGS. 6, 7 and 8 diagrammatically illustrate the structural components of one aluminum stud; and, FIGS. 9A, 9B, 9C and 9D diagrammatically illustrate another method of adhering studs to cloth.
Figure 7:
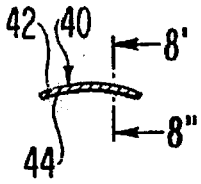
Figure 8:
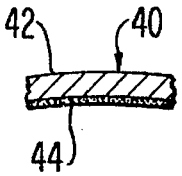

FIG. 6 diagrammatically illustrates circular or elliptical stud 40. Stud 40 is a thin sheet of aluminum. The stud is 25 point thick aluminum. Stud 40 has a top surface 42 that is polished or highly finished. The backside surface 44 includes a layer of heat sensitive adhesive thereon. FIG. 8 shows stud 40, aluminum substrate 42, and adhesive layer 44 thereon.

The Stud Table which follows provides some examples of the shapes and sizes of the studs in the working embodiment.

Stud Table

| Shape | Size(s) |
|---|---|
| Circle | 4 mm, 6 mm, 8 mm, 10 mm diameter |
| Star | 6 mm, 8 mm, largest diameter |
| Rectangle (bars) | 6 × 2.5 mm, 10 × 3 mm |
| Navette (generally oblong) | 8 × 4 mm |
| Water Droplet | 10 × 6 mm, 13 × 8 mm |
| Square | 7 × 7 mm |
| Lozenge (parallelogram) | 12 × 6 mm |
| Crescent Moon | 10 × 3 mm |
| Heart | 10 × 10 mm |
| Triangle | about 8 × 8 × 8 mm |

The following Pattern Table lists a number of patterns available and included in the kit which embodies one working embodiment of the present invention.

Pattern Table

| Pattern | Component Studs |
|---|---|
| 1. Waves | circles |
| 2. Arrows | circles, triangles, bars |
| 3. Stop sign | circles |
| 4. Boots | circles, triangles, stars |
| 5. Star Burst | stars, circles |
| 6. Question Mark | large and small circles |
| 7. Water Droplets | circles and water droplets |
| 8. Sun | circles |
| 9. Repeating, spaced dots | circles |
| 10. Roman numerals | circles |
| 11. Periodic wide loops | circles |
| 12. Opposing teardrops | circles |
| 13. Diamond; square, triangles | circles, squares, bars |
| 14. single and double interlocking rings | circles |
| 15. Fish | circles |
| 16. Balloons | circles |
| 17. Star constellations | circles |
| 18. Pyramid | circles |
| 19. Humanoid figures | circles, squares |
| 20. Butterfly | circles, bars |
| 21. Anchor | circles |
| 22. Sunflower | circle |
| 23. Airplanes | circle |
| 24. Cactus | circle |
| 25. Bicycle | circle |
| 26. Star | circle, star |
| 27. Heart | circle |
| 28. Cheshire cat smile | circle, stars |
| 29. Collar designs | all |
| 30. Edge pattern designs | all |
| 31. Police badge | circles, bars, stars |

A number of these stud patterns are included on a paper sheet sized not large than 2.5 square meters. For example, patterns 1–14 appear on one pattern sheet. Patterns 15–31 appear on the second pattern sheet. Although the pattern sheet used in conjunction with the working embodiment of the present invention is made of paper, any type of flexible stud pattern sheet can be utilized. The stud pattern sheet is. pierced either with a pin or other piercing implement or is pierced by a marking pen or pencil. In either event, the underlying cloth 10 shown in FIG. 1 is marked with the stud pattern.

The following Cloth Table lists the type of cloth that can be used in connection with the stud process of the present invention.

Cloth Table

Rayon
Polyester
Synthetic fabrics
Cottons
Denims
Wools
Washable silks
Suedes

The studs are relatively small and generally flat. However, the backside of each stud is slightly concave. It is estimated that the depth of the concave underside surface is between 0.5 and 1.0 mm. The thin, generally flat, shaped aluminum studs have the following properties as compared with the prior art brass studs.

Properties Table

| Material | Specific Gravity | Thermal Conductivity* | Thermal Expansion** |
|---|---|---|---|
| Aluminum alloy (not 99/9% pure) | 2.7(+) | 0.4(±) | $12 \times 10^{-6}$ |
| Brass (70 Cu - 30zn) | 8.5 | 0.3 | $11 \times 10^{-6}$ |

*in cal-cm (°c - $cm^2$ - sec. at 68° F.)
**in/in/°F. at 68° F.

It should be noted that aluminum studs permit the present invention to be utilized in a household environment. The aluminum stud and the low temperature adhesive permits the home based artisan to glue or adhere the studs on his or her clothing. Aluminum is not only cheaper than brass but also aluminum studs do not tarnish. Further, the aluminum studs have an exposed surface that is finished by brushing or polishing. The brass studs must be lacquered in order to prevent tarnishment. The brass studs are much heavier and therefor require an adhesive that has a greater adhering characteristic than the adhesive used with aluminum. Further, the use of aluminum studs permits the low temperature heat to be used to adhere the studs to the closing. An important aspect of the present invention is the utilization of aluminum studs with low temperature adhesives. As used herein, the phrase "low temperature adhesive" refers to an adhesive that is activated at temperatures around 130°–150° F. At those temperatures, the adhesive flows and adheres to both the backside of the stud and the clothing immediately adjacent thereto.

Figure 2:
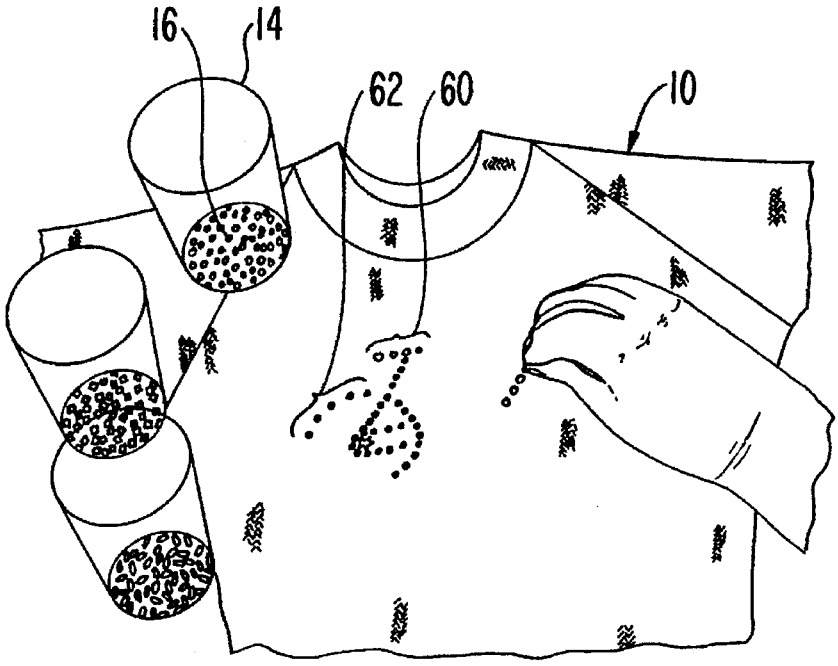

FIG. 2 illustrates that the user is placing studs of his or her choice on the marked regions of the cloth. For example, studs in region 60 have been placed atop the cloth marking in a pattern replicating the stud pattern shown on pattern sheet 12. The cloth is marked as shown in region 62.

Figure 3:
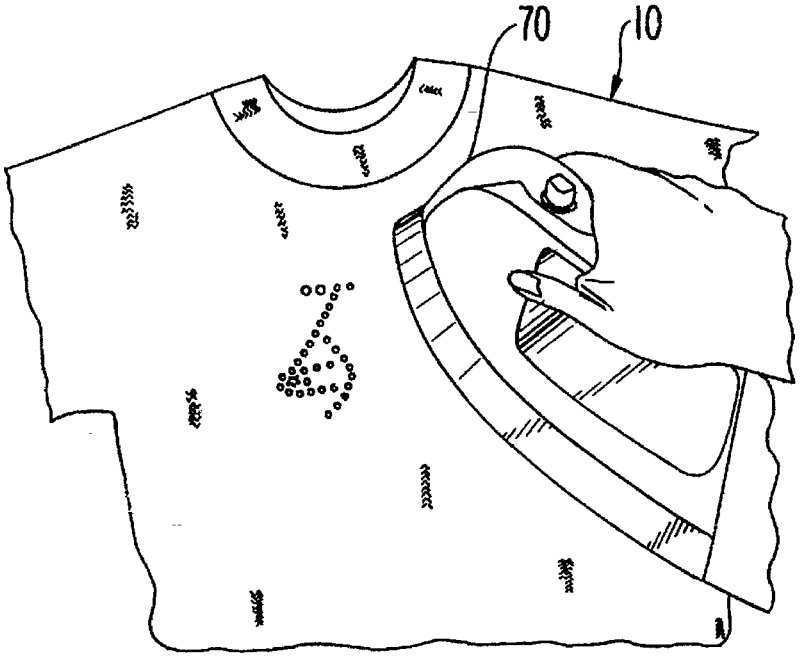
Figure 4:
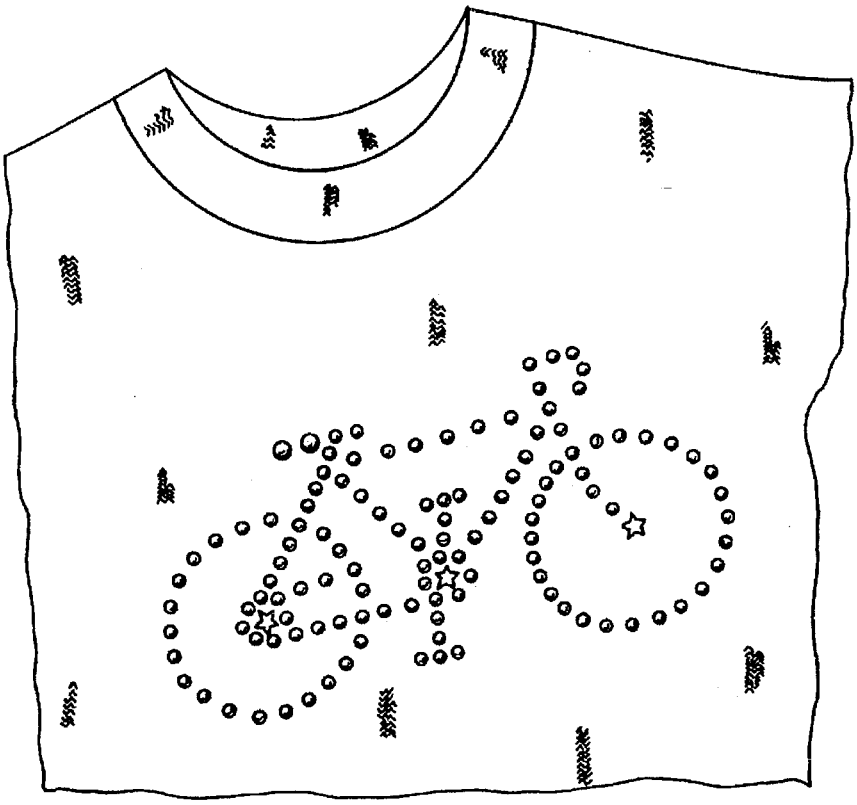

FIG. 3 diagrammatically illustrates that the user is compressing and applying heat in the region of 130°–150° F. via common household iron 70. The application of heat in that range and the compressive force of about 10 foot pounds is sufficient to glue or adhere the studs onto the cloth. The working embodiment of the invention has revealed that the studs can be glued or adhered to the cloth between 5–10 seconds. Denim cloth takes a slightly higher heat and it is recommended that the compressive heat be applied for up to 15 seconds. The iron should not be slid across or rotated atop the studs. If the studs should flip and accidentally bond to the heatable surface of the iron, a knife can easily remove the stud from the heatable surface of the iron. It should be noted that the stud patterns on the pattern sheet 12 can be made larger utilizing a photocopying machine. Accordingly, the patterns can be enlarged or reduced based on photocopy reduction or enlargement. In the working embodiment, it is important to put all the studs beneath the hot surface of the iron. Accordingly, it is recommended in home use that only small groups of studs be heated at one time. It is believed that the area to be heated should be less than one square foot.

FIG. 1, in combination with FIG. 5, shows the major components of the kit for adhering studs to cloth. The kit includes a plurality of aluminum studs as described above. The studs are organized into groups of similar shapes. Further, the purchaser is provided a pattern sheet not greater than 2.5 square meters. This pattern sheet can include a number of stud patterns as identified above in connection with the Pattern Table.

Figure 9A:
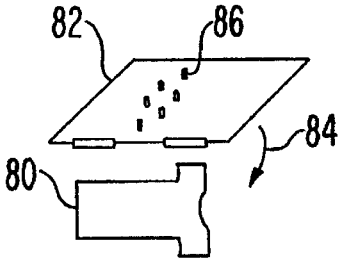
Figure 9B:
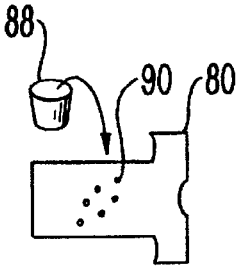
Figure 9C:
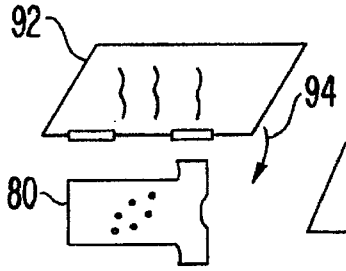
Figure 9D:
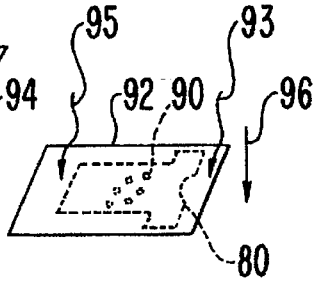

FIGS. 9A, 9B, 9C and 9D diagrammatically illustrate the industrial application of these studs. FIG. 9A shows clothing article 80 placed below marking panel 82 that pivots downward to pierce the article of clothing. Marking panel 82 is rotated downward as shown by arrow 84 such that markers 86 mark clothing article 80. FIG. 9B illustrates that container 88 is utilized to hold the plurality of studs. The studs are placed on the clothing article 80 as shown by stud 90. FIG. 9C illustrates a heat press 92 which is moved in direction 94 and placed atop clothing article 80. FIG. 9D shows that heat press 92 is compressing studs 90 as shown by force vector 96. Heat 93, 95 is simultaneously applied to the clothing article 80. In such a manner, the aluminum studs can be adhered to the clothing article.

The claims appended hereto are meant to cover modifications and and changes within the spirit and scope of the present invention.

I claim:

1. A method of adhering studs to cloth comprising the steps of:

providing a plurality of studs consisting of generally flat aluminum shapes having a backside surface covered with a heat sensitive adhesive;

providing at least one predetermined stud pattern;

laying said stud pattern atop said cloth at a desired location;

replicating said stud pattern on said cloth by marking the cloth;

removing said stud pattern from said cloth;

placing a corresponding stud on each respective cloth mark after removal of said pattern;

simultaneously compressing and applying 130°–150° F. of heat to said studs and said cloth for a predetermined period of time and thereafter withdrawing said heat and compression, said compression and heat activating said adhesive and adhering said studs to said cloth.

2. A method as claimed in claim 1 wherein the step of applying heat includes the step of compressing and applying heat over an area of less than one square foot, said studs distributed in said predetermined stud pattern within said heated area.

3. A method as claimed in claim 1 wherein each stud has a finished surface which is exposed and an opposing backside surface which is surface covered with said heat sensitive adhesive, said heat being applied to said exposed surface.

4. A method as claimed in claim 1 including the step of laying out said cloth on a flat, heat resistant surface prior to the application of heat.

5. A method as claimed in claim 1 including the step of penetrating said stud pattern to mark the cloth lying therebelow.

6. A method as claimed in claim 1 including the step of marking said cloth during the replication step by one of piercing the stud pattern and said cloth and marking said cloth with a dye mark.

7. A method as claimed in claim 6 including the step of removing said stud pattern prior to the application of heat.

8. A method as claimed in claim 1 wherein said compression and heat application step includes the step of applying about 10 foot pounds of compressive force to the studs during the application of said heat thereon.

9. A method as claimed in claim 1 including the step of cooling the heated studs, adhesive and cloth, after the application of heat, for a predetermined period of time.

10. A method as claimed in claim 2 wherein each stud has a finished surface which is exposed and an opposing backside surface which is surface covered with said heat sensitive adhesive, said heat being applied to said exposed surface.

11. A method as claimed in claim 10 including the step of laying out said cloth on a flat, heat resistant surface prior to the application of heat.

12. A method as claimed in claim 11 including the step of penetrating said stud pattern to mark the cloth lying therebelow.

13. A method as claimed in claim 12 including the step of removing said stud pattern prior to the application of heat.

14. A method as claimed in claim 13 including the step of marking said cloth during the replication step by one of piercing the stud pattern and said cloth and marking said cloth with a dye mark.

15. A method as claimed in claim 14 wherein said compression and heat application step includes the step of applying about 10 foot pounds of compressive force to the studs during the application of said heat thereon.

16. A method as claimed in claim 15 including the step of cooling the heated studs, adhesive and cloth, after the application of heat, for a predetermined period of time.

* * * * *